United States Patent [19]

Tripoli et al.

[11] 4,415,304

[45] Nov. 15, 1983

[54] SYSTEM FOR FLOATINGLY SUPPORTING A LOAD

[75] Inventors: Antonino Tripoli; Bruno Baldi; Bruno Piacentini, all of Rome, Italy

[73] Assignee: Seienia, Industrie Elettroniche Associate, S.p.A., Rome, Italy

[21] Appl. No.: 342,392

[22] Filed: Jan. 25, 1982

[30] Foreign Application Priority Data

Jan. 26, 1981 [IT] Italy ..... 47638 A/81

[51] Int. Cl.[3] ..... B66F 5/00

[52] U.S. Cl. ..... 414/589; 29/234; 29/272; 33/180 R; 89/1.805; 89/1.816; 89/1.819; 248/639; 248/654; 254/89 H; 269/296; 269/289 MR

[58] Field of Search ..... 414/749, 589; 89/1.5 R, 89/1.8, 1.801, 1.805; 269/289 MR, 296; 254/89 H; 29/272, 234; 248/639, 654, 647; 116/215; 206/3; 108/55.3; 33/180 R, 181 R, 191

[56] References Cited

U.S. PATENT DOCUMENTS 1,311,804 7/1919 Donaldson ..... 269/296

3,022,031 2/1962 Bauer et al. ..... 89/1.8 X 4,245,945 1/1981 Rizzo ..... 414/589 X

*Primary Examiner*—Robert J. Spar

*Assistant Examiner*—Donald W. Underwood

*Attorney, Agent, or Firm*—Karl F. Ross

[57] ABSTRACT

A heavy and elongate recumbent load, such as a missile, is floatingly supported by two pairs of hydraulic pistons engaging it forwardly and rearwardly of its center of gravity, the pistons of each pair being oppositely inclined at 45° to the horizontal. Each piston is part of a single-acting jack whose cylinder has its bottom end connected via a pair of antiparallel check valves to a source of hydraulic fluid, such as a pump in parallel with an accumulator, whose pressure substantially balances the component of the load bearing upon the respective piston. Each check valve has a bising spring so adjusted that it allows the valve to open in response to a manual force applied to the load near the point of attack of the associated piston whereby the load can be reoriented by hand, e.g. for alignment with a launching tube into which a missile is to be inserted with the aid of a carriage equipped with the four hydraulic jacks.

5 Claims, 7 Drawing Figures

SYSTEM FOR FLOATINGLY SUPPORTING A LOAD

FIELD OF THE INVENTION

Our present invention relates to a system for floatingly supporting a missile or other elongate load in a recumbent position to facilitate its alignment with a predetermined horizontal reference line, e.g. a line extending in the longitudinal direction of an open-ended container such as a launching tube into which the load is to be inserted.

BACKGROUND OF THE INVENTION

The type of load here primarily contemplated is a missile weighing roughly 200 kg with a length of about 4 meters and a diameter between approximately 20 and 50 cm. An erectable launching tube of square cross-section, to be loaded with a missile while in its horizontal position, is conventionally provided in the upper part of its interior with slotted guide rails which accommodate hook-type projections or latches in a central area of the missile body serving to anchor the missile within that tube and to facilitate its erection. The latches fit into their guide slots with small clearance, usually on the order of 0.3 mm, so as to make the alignment very critical. Manual orientation is still the best way of insuring that the missile slides in correctly without overstressing any part of its body or of the tube wall. It is also important that the missile be externally supported until its body has been introduced into the tube, in order to prevent the generation of excessive friction between the slotted guide rails and the latches engaged thereby.

Other loads of the same general type require similar handling during alignment with a receptacle therefor or with an object to be coupled thereto.

Attempts to minimize the effect of gravity by suspending such a load from suitable springs have not fully resolved the problem. With a heavy load such as the aforementioned missile, weight-balancing springs would have to be impractically large.

OBJECTS OF THE INVENTION

Thus, the general object of our present invention is to provide an improved system for the floating support of an elongate load to facilitate its displacement in any transverse direction.

A more particularly object is to provide a supporting system of this type enabling the load to be manually moved with five degrees of freedom, i. e. horizontal and vertical translational motion and rotation about three mutually orthogonal axes passing through its center of gravity.

SUMMARY OF THE INVENTION

We realize these objects, in accordance with our present invention, by the provision of a first and a second pair of hydraulic jacks disposed in respective vertical planes perpendicular to the reference line with which the load is to be aligned, the jacks of each pair lying below the level of the reference line on opposite sides of another vertical plane including that line. The jacks of each pair have inclined axes which intersect each other in the vicinity of the reference line and are each provided with a single-acting piston movable along their axis for engagement with a load whose center of gravity lies substantially midway between the aforementioned transverse planes. The jacks are connected to a source of hydraulic fluid under a pressure which approximately or completely balances the weight component of the engaged load acting upon the respective piston.

Pursuant to a more particular feature of our invention, each jack has a piston cylinder connected at its bottom to the fluid source via a pair of conduits which are provided with antiparallel check valves urged into a closure position by respective loading springs. The sum of the biasing force of each loading spring and the aiding fluid force exceeds but slightly the opposing fluid force normally prevailing in the respective conduit. In this way, each load-engaging piston will remain in the position last attained until a control force sufficient to open one or the other check valve is applied to the load (e. g. by hand) near the point of engagement.

Advantageously, the axis of each jack is inclined to the horizontal at an angle of 45° so that the pistons of each pair absorb mutually orthogonal weight components.

In the particular instance of a missile or other elongate load which is to be longitudinally displaced after reaching its alignment position, the jacks can be mounted on a carriage which is movable parallel to the reference line.

BRIEF DESCRIPTION OF THE DRAWING

The above and other features of our invention will now be described in detail with reference to the accompanying drawing in which.

SPECIFIC DESCRIPTION

Figure 1:
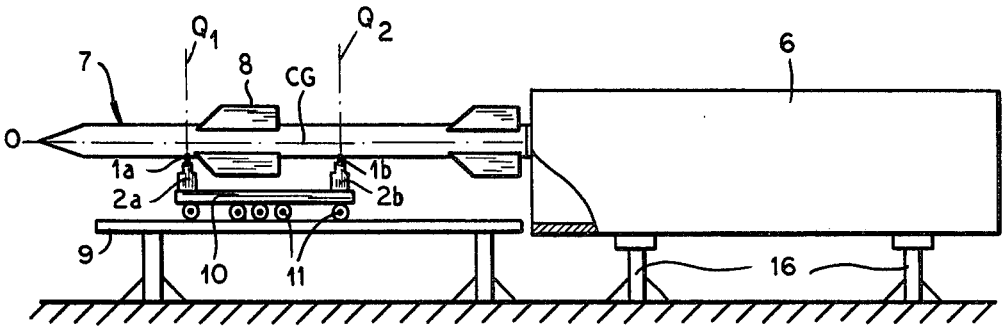
FIG. 1 is a side-elevational view of a missile about to be introduced into a launching tube with the aid of a carriage equipped with our improved load-supporting system.

In FIG. 1 we have illustrated a missile 7 whose axis 0 is approximately aligned with a longitudinal reference line in an upper part of a recumbent launching tube 6. Tube 6 is shown supported above ground on stilts 16 and may be provided with means for erecting it by a pivotal motion about a transverse rear axle, e.g. by an extensible jack as described in commonly owned application Ser. No. 334,460 filed Dec. 28, 1981 by Armando Peruzzi. The open left-hand end of this tube faces the tail of missile 7, provided with the usual stabilizer fins 8, which is floatingly supported by a system according to our invention on a platform 9 via a carriage 10 equipped with driven wheels 11 whereby the carriage can be rectilinearly displaced parallel to axis 0. Platform 9 lies approximately on the level of the floor of the launching tube 6.

Our improved support system, more fully described hereinafter with reference to FIGS. 2–5, comprises two pairs of hydraulic jacks disposed in respective planes $Q_1$ and $Q_2$ which are transverse to axis 0 and lie on opposite sides of the center of gravity CG of missile 7, preferably at identical distances therefrom. The two jacks visible in FIG. 1 have pistons 1*a*, 1*b* and cylinders 2*a*, 2*b*; their companion jacks, indicated in subsequent Figures, have pistons 1*c*, 1*d* and cylinders 2*c*, 2*d*. The free ends of the piston rods carry rollers 17 (FIG. 2), of rubber or the like, designed for frictional engagement with the missile body.

Figure 2:
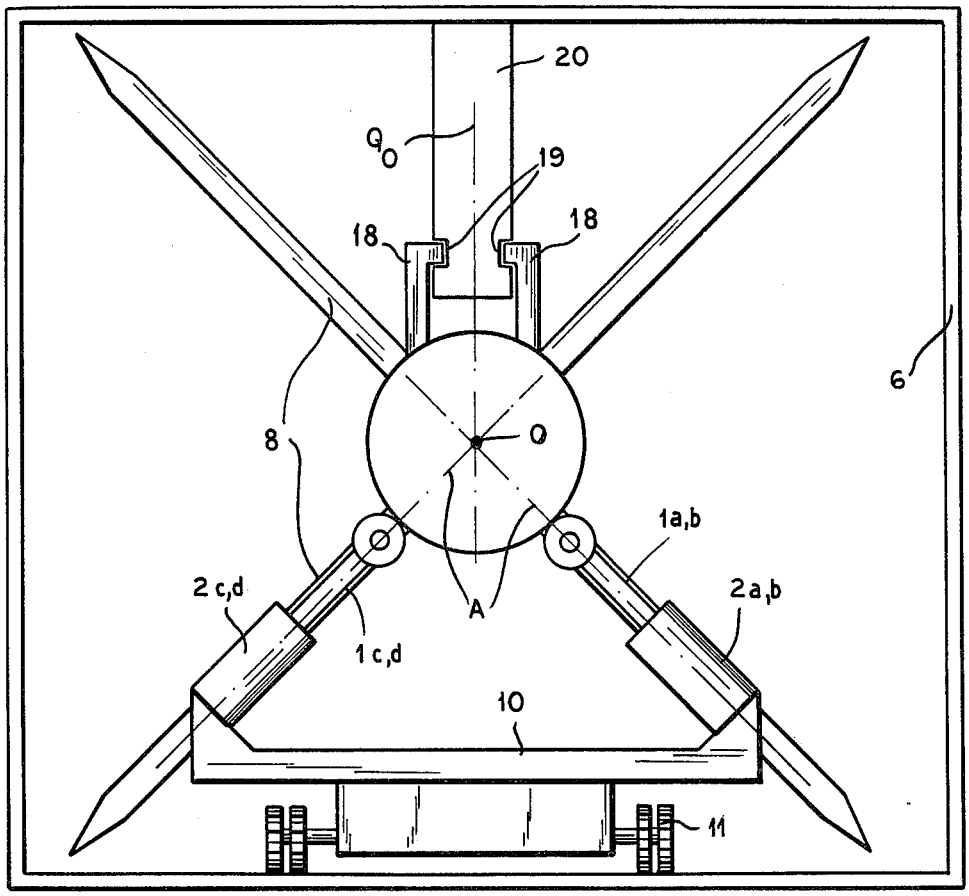
FIG. 2 is a somewhat diagrammatic end view of the missile, showing a pair of hydraulic jacks forming part of our supporting system.
Figure 3A:
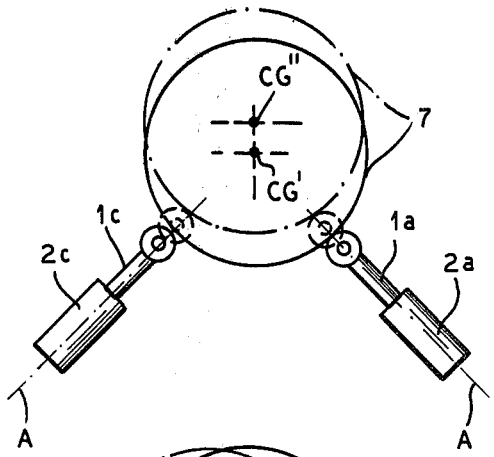
FIGS. 3A, 3B and 3C diagrammatically illustrate respective modes of displacement of the missile by the jacks shown in FIG. 2.
Figure 3B:
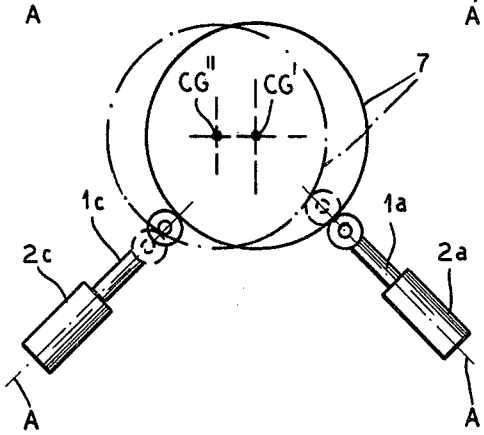
Figure 3C:
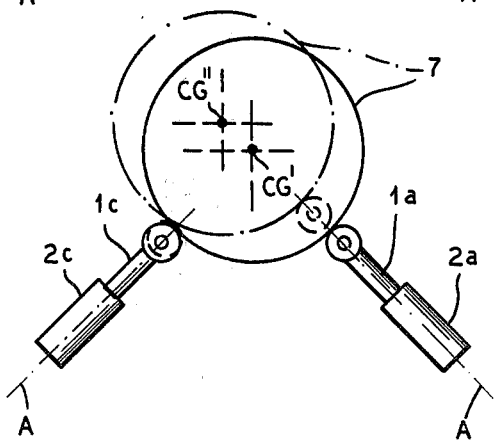

As seen in FIG. 2, the jacks of each pair have individual axes A that are oppositely inclined to the horizontal at 45° and intersect in the vicinity of axis 0, these jacks lying on either side of a vertical plane $Q_o$ which includes the missile axis; the center of gravity CG of missile 7 lies on axis 0. Generally, there will be an initial offset between missile axis 0 and the reference line of the launching tube which has to be corrected by a suitable reorientation, e.g. a translational motion as diagrammatically illustrated in FIGS. 3A, 3B and 3C. Starting from a position in which a projection CG′ of the center of gravity upon the plane $Q_1$ lies at the intersection of axes A of jacks 1*a*, 2*a* and 1*c*, 2*c*, FIG. 3C illustrates in phantom lines an elevation of the front portion of the missile so that this projection assumes a position CG″; that motion causes an extension of pistons 1*a* and 1*c* by identical distances. FIG. 3B analogously shows a lateral shift accompanied by an extension of piston 1*a* and a retraction of piston 1*c*. In FIG. 3C the displacement is diagonal, with extension of piston 1*a* and only a minor change in the position of piston 1*c*.

As will be apparent, a swing of the missile about any transverse axis passing through its center of gravity can be brought about by diametrically opposite shifts of its forward and rearward parts. The rollers 17 carried by the pistons facilitate a rotation of the missile about its longitudinal axis.

FIG. 2 also shows latches 18 on the missile body closely fitting into slots 19 of a longitudinal guide rail 20.

Figure 4:
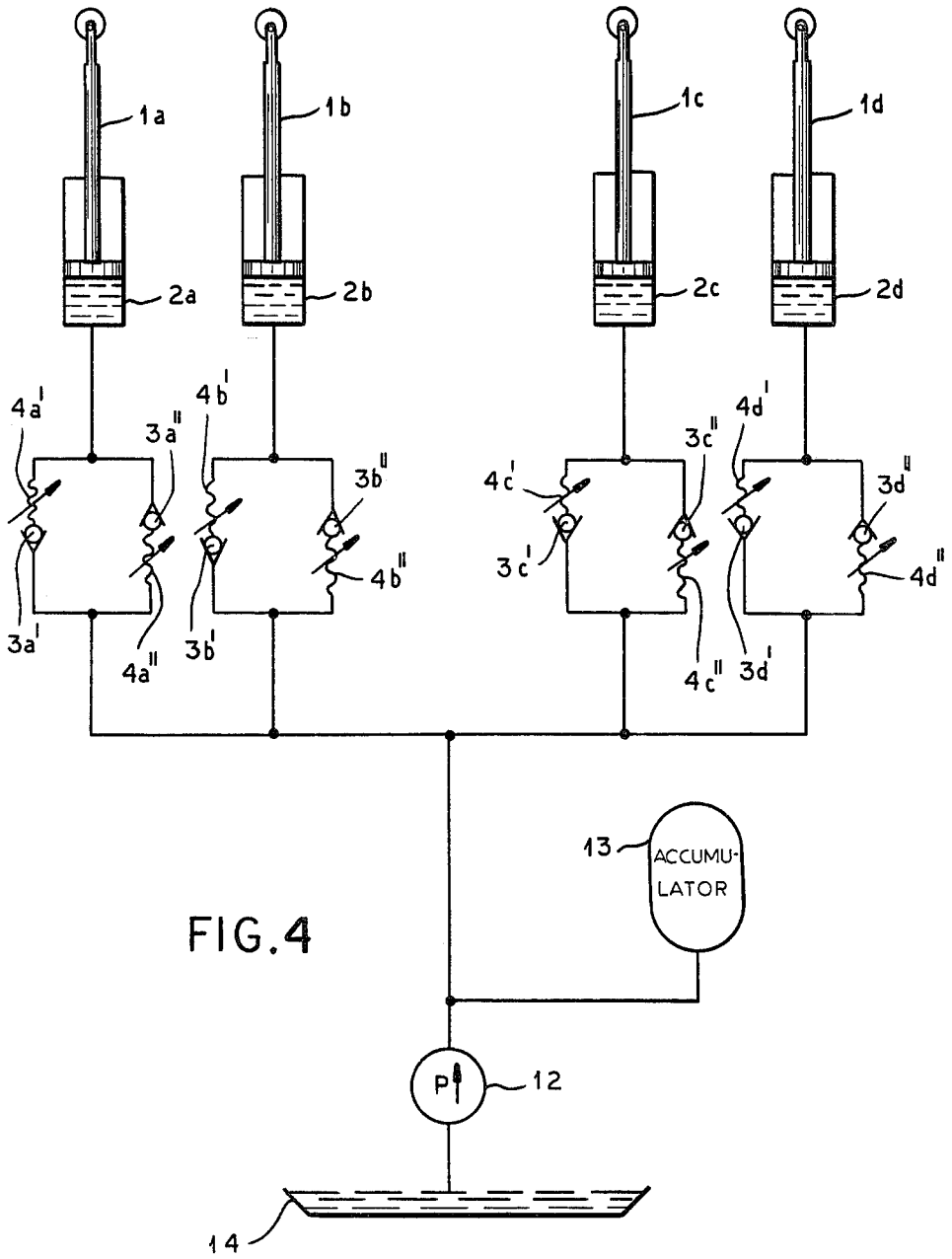
FIG. 4 is a diagram of the hydraulic circuit of the load-supporting system.

FIG. 4 shows the two pairs of jacks with their respective single-acting pistons 1*a*–1*d* and cylinders 2*a*–2*d* whose lower ends are connected to a source of high-pressure fluid (oil) represented by a pump 12 and an accumulator 13 of large capacity as well as an oil reservoir 14. The hydraulic connection between each cylinder and source 12–14 includes a pair of oppositely acting check valves 3*a*′, 3*a*″; 3*b*′,3*b*″; 3*c*′, 3*c*″; 3*d*′, 3*d*″. Each check valve is biased into its flow-blocking position by an adjustable loading spring 4*a*′, 4*a*″; 4*b*′, 4*b*″; 4*c*′, 4*c*″; 4*d*′, 4*d*″. In practice, the two antiparallel check valves of each jack may be disposed in respective ports at the bottom of the associated cylinder.

Figure 5:
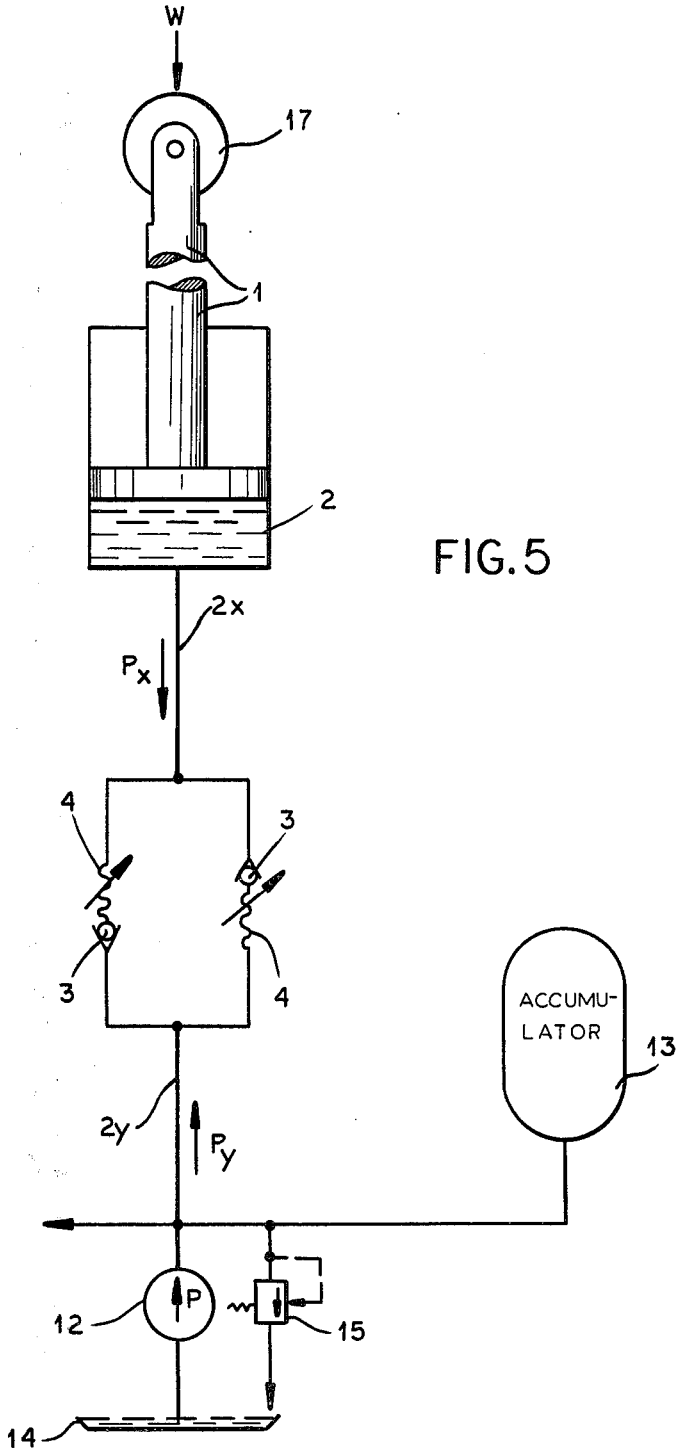
FIG. 5 shows part of the hydraulic circuit of FIG. 4 in greater detail.
Figure 5:
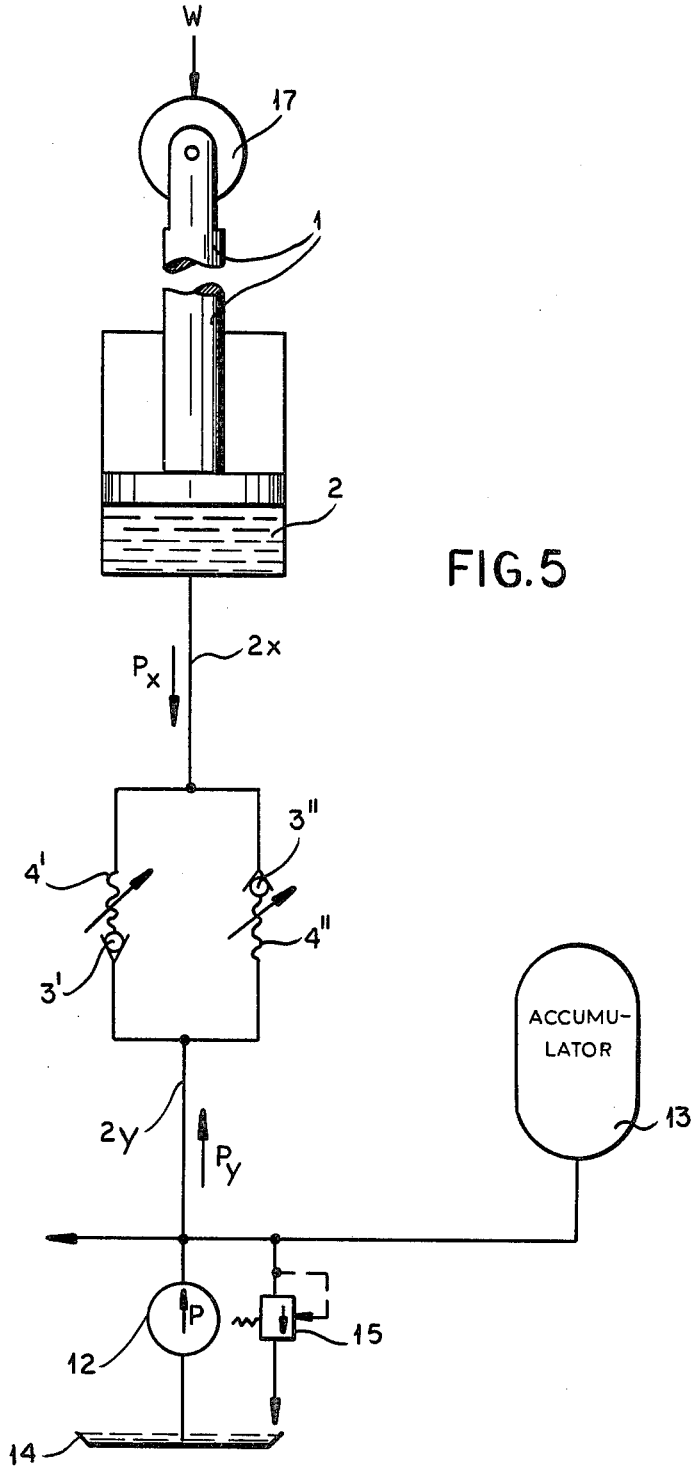

A single jack 1, 2, representative of any of the jacks shown in FIG. 4, has been illustrated in FIG. 5 where the associated check valves and their springs have been designated 3′, 3″ and 4′, 4″. The hydraulic connection between these check valves and the cylinder 2 has been indicated as a conduit 2*x* (which in practice could be very short), a corresponding connection 2*y* extending from the check valves to source 12–14. Pump 12 is shown provided with the usual pressure-relief valve 15 enabling an overflow of oil to return to reservoir 14. Valve 15 is so calibrated that the pump pressure prevailing in conduit portion 2*y* exerts upon the check valves an upward fluid pressure $P_y$ substantially balancing a downward fluid pressure $P_x = W/S$ generatedin conduit portion 2*x* by the weight component W acting through the piston 1 upon the oil in the bottom part of cylinder 2, S being the cross-sectional area of the jack.

The suitably adjusted loading springs 4′ and 4″ exert upon their check valves 3′ and 3″ respective biasing forces establishing threshold pressures P′ and P″, with $$P_y - P_x \equiv \Delta P' < P' \quad (1)$$

and $$P_x - P_y \equiv \Delta P'' < P' \quad (2)$$

so that both check valves are closed as long as no overriding forces acts upon the load 7 in a direction in which a component of that force coincides with the axis of the jack. The excess of the threshold pressure over the corresponding pressure difference represents a hysteresis stabilizing the missile in the position last attained.

In order to move the load, it is merely necessary to exert a supplemental force f in the direction of that axis with generation of a pressure increment $p = f/S$ so that the algebraic sum of p and $\Delta P'$ or $\Delta P''$ exceeds the threshold pressure P′ or P″ of spring 4′ or 4″. With suitable selection of the spring forces and the pump pressure, the minimum control force $f_{min}$ can be made as small as required for stabilization of the load against spontaneous displacement. With $P_x \approx P_y$, the spring forces can be identical.

With the missile properly aligned, carriage 10 can be actuated to enter the launching tube 6 together with the missile 7 supported thereon. When the missile has been properly anchored to the tube by its latches, the jacks are retracted so that carriage 10 can be withdrawn by reverse energization of its drive mechanism.

Since a pivotal swing about any transverse axis only involves a transfer of oil from one pair of cylinders to the other, the contents of accumulator 13 are not changed by such a maneuver. To a certain extent this is also true of a lateral shift as shown in FIG. 3B.

It will be understood that, especially in the case of loads of great length, additional pairs of jacks of the kind described can be used as intermediate floating supports at locations closer to the center of gravity.

If the missile 7 loaded into tube 6 is to be removed therefrom, carriage 10 is reinserted into the left-hand tube end with its jacks retracted until it is properly positioned under the missile body, i.e. with its center of gravity equidistant from the planes $Q_1$ and $Q_2$ of the jacks. The pump 12 is then activated in order to transfer the weight of the missile from the tube guides to the carriage whereupon the latter can be driven to the left for safely extracting the missile. A precise alignment of platform 9 with the tube floor is not essential for either loading or unloading.

We claim:

1. A system for floatingly supporting an elongate load in a recumbent position to enable manual alignment thereof with a predetermined horizontal reference line, comprising a first and a second pair of hydraulic jacks disposed in respective vertical planes perpendicular to said reference line, the jacks of each pair lying below the level of said reference line on opposite sides of another vertical plane including said reference line and having inclined axes intersecting in the vicinity of said reference line, each of said jacks being provided with a single-acting piston movable along the axis thereof for engagement with a load whose center of gravity lies substantially midway between respective vertical planes, said jacks being connected to a source of hydraulic fluid under a pressure substantially balancing the weight component of the engaged load acting upon the respective piston.

2. A system as defined in claim 1 wherein each jack has a piston cylinder connected at a bottom end thereof to said source via a pair of conduits provided with anti-parallel check valves each biased by a respective loading spring whose force exceeds but slightly the value necessary to hold the corresponding check valve normally closed.

3. A system as defined in claim 1 or 2 wherein the axis of each jack is inclined to the horizontal at 45°.

4. A system as defined in claim 1 or 2, further comprising a carriage movable parallel to said reference line, said jacks being mounted on said carriage.

5. A system defined in claim 1 or 2 wherein said source comprises a pump in parallel with a pressure accumulator.

* * * * *